US005520122A

United States Patent [19]

Fischer

[11] Patent Number: 5,520,122

[45] Date of Patent: May 28, 1996

[54] FURNITURE HAVING A STATIONARY TOP AND ARTICULATED LEAVES

[76] Inventor: Matthias Fischer, Feuerbachstrasse 36, 60325 Frankfurt, Germany

[21] Appl. No.: 245,553

[22] Filed: May 18, 1994

[30] Foreign Application Priority Data

Jan. 17, 1994 [EP] European Pat. Off. ..... 94100586

[51] Int. Cl.[6] ..... A47B 1/04

[52] U.S. Cl. ..... 108/71; 108/75; 108/95

[58] Field of Search ..... 108/71, 73, 75, 108/76, 69, 94, 59, 93, 65, 95, 96, 66, 84, 85, 106, 110

[56] References Cited

FOREIGN PATENT DOCUMENTS 4207743 9/1993 European Pat. Off. .

*Primary Examiner*—Jose V. Chen

*Attorney, Agent, or Firm*—Evenson, McKeown, Edwards & Lenahan

[57] ABSTRACT

A piece of furniture comprises a stationary top as well as at least two leaves which, in the rest position underneath the stationary top, are disposed in parallel above one another at respective different planes and have guiding devices of different slopes. Each leaf is held by a supporting element whose areas situated outside the leaf contour do not intersect the path of the movement of at least one other leaf.

8 Claims, 3 Drawing Sheets

FURNITURE HAVING A STATIONARY TOP AND ARTICULATED LEAVES

BACKGROUND AND SUMMARY OF THE INVENTION

The present invention relates to a piece of furniture having a stationary top as well as at least one leaf which is disposed about a bearing axis situated outside-the leaf contour and swivellable; by guiding devices on a stationary bearing point of the piece of furniture. The leaf is swivelled parallel to the stationary top, and vertically displaced about the bearing point between a rest position situated underneath the stationary top and an enlarging position aligned with the height of the top.

German Patent No. DE 4,207,743 Al shows a table which can be enlarged by a leaf which is disposed eccentrically on a table leg. The leaf is rigidly connected with a tube-shaped sleeve which is pushed onto the table leg and the lower front edge of which rests on a pin which projects radially away from the table leg. Along its circumference, the front edge has a helical curve whose slope is dimensioned such that, when the leaf is swivelled out of a rest position underneath the table top, it is vertically displaced into an enlarging position which is aligned with the table surface.

It is an object of the present invention to provide a piece of furniture which offers improved possibilities with respect to configuration and size.

This object has been achieved in that at least two leaves are provided which, in the rest position underneath the stationary top, are disposed in respective different planes in parallel above one another and have guiding devices with different slopes. Each leaf is held by a supporting element whose areas situated outside the leaf contour do not intersect the path of the movement of the at least one other leaf. A table, in particular, is provided as the piece of furniture. However, the present invention is also applicable to other pieces of furniture such as shelves, sideboards and the like. As a result, it becomes possible to provide one or more leaves for enlarging the stationary top which, in the enlarging position joined to the stationary top, are at the same level as the stationary top and are therefore aligned with the surface of the top.

It is an important advantage of the present invention that completely new dimensions are created for the enlarging of tops. The reason is that, by virtue of the arrangement of the leaves at different levels, leaves which are significantly enlarged in comparison to prior art can be provided and which, in the top view, overlap in the rest position under the stationary top. As a result, it is also possible to enlarge relatively wide tables along their full width by way of one-piece leaves. Because the leaves are disposed above one another, the extent of the enlargement of the stationary top is no longer, as was the case with conventional pieces of furniture, dependent on the overall length of the stationary top underneath which the leaves are disposed. The present invention permits even a short table to be enlarged to create a large surface.

As a result of the fact that the areas of the supporting element for holding the leaf, which project, in particular, on the underside and on the upper side of the leaf beyond the leaf contour, do not intersect the path of movement of the other leaf, the leaves can be guided past one another during their swivel movement without being blocked by projecting areas of the supporting element of the respective other leaf.

Supporting arms, angles and other supports which reach over the leaf on its upper and lower side in a thickening manner are provided as supporting elements. A supporting arm which, for holding the leaf, projects radially thereunder, is therefore maximally dimensioned only so that its front face does not intersect the path of movement of the front contour of the other leaf. In the case of symmetrical tables and resulting leaves of equal sizes, the radial length of the supporting arm is therefore dimensioned to be less than the radius of the path of the movement of the other leaf.

In one embodiment of the invention, the two leaves are disposed one side of the stationary top. As a result, when the piece of furniture is arranged in a room, it is sufficient to provide a little more -space for the swivelling-out of the leaves on one side of the stationary top. This is particularly advantageous also when the piece of furniture is set up in proximity of a wall of the room because the piece of furniture does not have to be pushed away from the wall for the purpose of enlarging the stationary top.

According to a further feature of the present invention, the leaves are significantly thinner than the stationary top. As a result, it is possible to arrange the leaves in their rest position largely invisibly underneath the stationary top since, because of the small thickness of the leaves, the height of the space required for the storing underneath the stationary top is relatively low. It is therefore possible to keep the overall height of a table relatively low despite the storing of the leaves underneath the table top, and to nevertheless maintain sufficient space for the leg movements of persons sitting at the table.

Yet another feature of the present invention is that the leaf can be held on the support arm so that it can be height adjusted. As a result, it is possible to adjust the leaf relative to the stationary top in order to compensate tolerances which could lead to different heights of the leaf and the stationary top.

Still another feature of the invention provides that the guiding devices of the bearing point for a swivelling of the leaf are arranged directly in the area of the stationary top. Because of the arrangement of the guiding devices for the swivelling of the leaf directly in the area of the stationary top, this leaf, in contrast to conventional arrangements, must not necessarily be disposed on a table leg in order to achieve, by way of a sufficient guiding length, a secure tube-shaped bearing. The leaf must therefore no longer necessarily be placed on a leg which extends to the floor and which at the same times serves for supporting the stationary top. The leaf may therefore also be provided in the case of round tables which only have a supporting leg in the center.

In a further embodiment of the invention, the guiding devices are arranged in a cylindrical upper area of a supporting leg which supports the stationary top. Because the guiding devices are arranged in the upper area of the supporting leg, the remaining area of the support leg may be configured in any shape, for example, as a square profile or similar shape.

In a still further embodiment of the invention, the guiding devices are provided on a cylindrical bearing stump arranged on an underside of the stationary top. This stopper-type supporting stump can be mounted at arbitrary points on the underside of the stationary top and is used only for the bearing of the leaf and not, as with conventional arrangements, additionally as a supporting leg of the stationary top which is advantageous particularly for round tables.

The present invention also contemplates at least one connecting link guide and at least one sliding block engaging in this connecting link guide as the guiding devices and assigned to a stationary and a rotating bearing part of the bearing of the leaf. In this case, at least one part of the connecting link guide has a slope which corresponds to the ratio of the swivel angle and the height difference of the leaf between the rest position and the enlarging position. It is therefore possible in a simple manner to optimize the path of movement of the leaf when it is moved from the rest position into the enlarging position. By using a connecting link guide and a sliding block, a restricted guidance is achieved so that the height of the bearing sleeve for the bearing of the leaf is significantly reduced in comparison to known arrangements where the height of the tube sleeve was required for the guiding in order to ensure that the lower front edge is sufficiently pressed against the table leg pin and order to prevent a tilting of the leaf. It is particularly advantageous for the tilting stress onto the bearing point to be absorbed in several sliding blocks, preferably three, which are distributed along the circumference of the bearing part.

In yet another embodiment of the invention, in the enlarging position, the mutually facing edge area of the leaf and of the stationary top can be coupled with one another at a distance from the bearing point by a supporting device. As a result, the leaf, which is disposed in a corner area, is additionally supported in the enlarging position by the coupling with the stationary top, whereby a sufficient stability is achieved even in the case of larger leaves. A bending-through of the leaf when fairly heavy objects are placed at a distance from the bearing point is therefore avoided. Thus, even in the case of relatively wide stationary tops, leaves may be used which correspond to the width of the stationary top to improve the variation possibilities with respect to the shape and the size of the pieces of furniture.

According to another aspect of the invention, the supporting device is provided with a locking element for the locking of the stationary top and the leaf with respect to one another. Consequently, the leaf cannot be unintentionally swivelled back from the enlarging position to create a gap between the mutually facing edge areas of the stationary top and the leaf.

In still a further aspect of the present invention, the supporting device has two mutually corresponding connecting element, one of which is assigned to the edge area of the leaf and the other of which is assigned to the edge area of the stationary top. The elements are form-lockingly or non-positively connectable by the swivelling movement of the leaf into the enlarging position. As a result, the locking of the leaf on the stationary top takes place in a simple manner by way of the swivel movement of the leaf toward the stationary top so that additional manipulations are avoided.

In yet a further aspect of the invention, the supporting device has a stationarily disposed locking lever which can be swivelled in an oblique plane and which, during the swivel movement for the locking and support of the leaf on the underside of the leaf reaches behind a crescent-shaped locking plate in a tangential manner, the radius of the crescent being smaller than the swivel radius of the locking lever. It is advantageous in this embodiment that the locking lever during its swivel movement for supporting and locking the leaf reaches under the leaf and, as a result, already supports it vertically. During a further swivel movement, the locking lever pulls the leaf toward the stationary top and presses the leaf to the level aligned with the surface of the stationary top.

BRIEF DESCRIPTION OF THE DRAWINGS

These and other objects, features and advantages of the present invention will become more readily apparent from the following detailed description thereof when taken in conjunction with the accompanying drawings wherein.

DETAILED DESCRIPTION OF THE DRAWINGS

Figure 1:
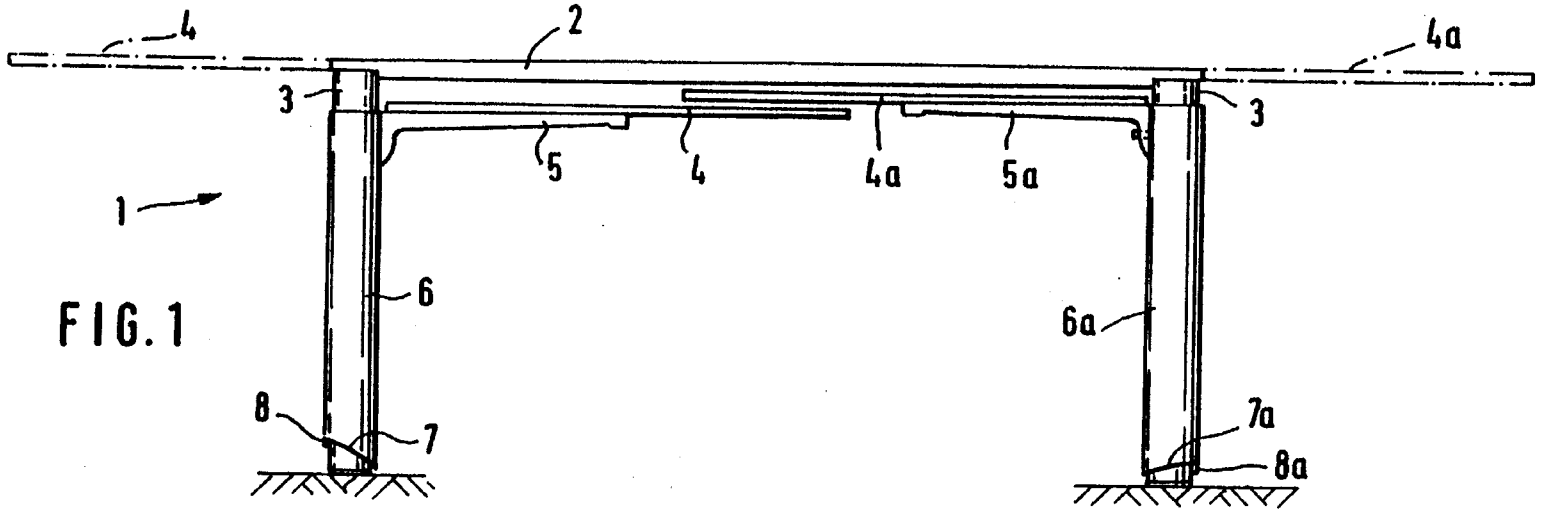
FIG. 1 is a side view of one embodiment of a piece of furniture according to the present invention in the form of a table which is provided with two leaves arranged at different levels above one another in the rest position.
Figure 2:
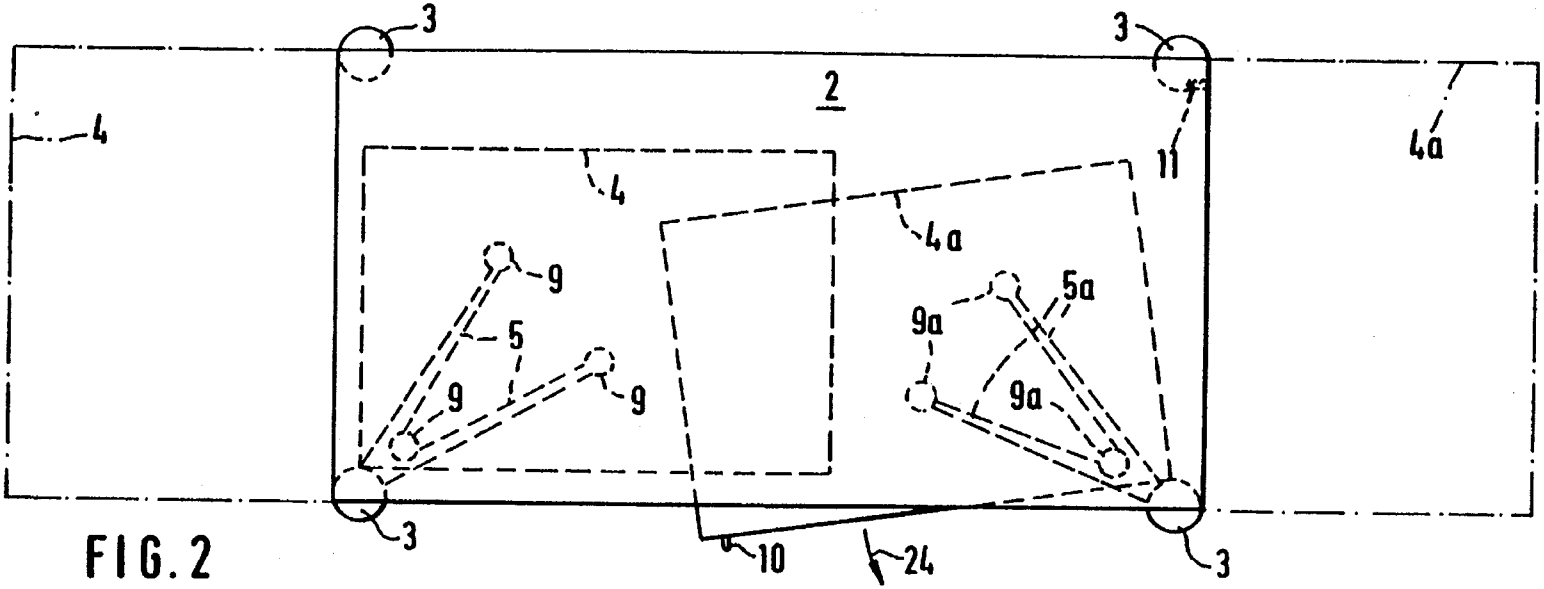
FIG. 2 is a plan view of the table according to FIG. 1 which illustrates the arrangement of each leave underneath the table top and the statically determined three-point bearing of each leaf on a supporting arm.

Referring now to FIGS. 1 and 2, a table 1 has a rectangular table top 2 which is supported on its four corners by four cylindrically-shaped table legs 3. As seen in the plan view according to FIG. 2, on the opposite longitudinal sides of the table top 2, the table legs 3 project partially from under the table top 2. Two leaves 4, 4*a* can be joined to the table top 2 on its opposite broad sides. The two leaves 4, 4*a* have the same size and a rectangular configuration. The length of the opposite longitudinal sides of the two leaves 4, 4*a* corresponds to the width of the table top 2. The two leaves 4 and 4*a* are therefore approximately half as thick as the table top 2.

In the enlarging or expanded position of the table 1, both leaves 4, 4*a* are joined to the table top 2 on its opposite broad sides as seen by the dot-dash lines in FIGS. 1 and 2. In this enlarging position, the leaves 4, 4*a* are aligned with the table top 2. That is, the surfaces of the leaves 4, 4*a* serving as the adjusting surface are situated at the same level as the table surface of the table top 2. In the enlarging position in which the lateral longitudinal edges of the leaves 4, 4*a* which face the table top 2 rest against opposite lateral broad edges of the table top 2, a uniform table surface is obtained which is almost twice as large as the table surface of the table top 2.

Each leaf 4, 4*a* is held on a supporting arm 5, 5*a* which is forked in a V-shape. In its rest position, in which no table enlargement is required, each leaf is situated underneath the table top 2 (FIG. 1 and representation of the leaf 4 in FIG. 2 shown by an interrupted line). The leaves 4, 4*a* are horizontally swivellably disposed on two table legs 3 which are mutually adjacent along a longitudinal side of the table top 2. The bearing of each leaf 4, 4*a* on the respective table leg 3 takes place outside the leaf contour in the area of a corner of each leaf 4, 4*a*. Each leaf 4, 4*a* is held on the pertaining supporting arm 5, 5*a* such that, in the rest position of each leaf 4, 4*a*, the longitudinal sides of the leaf 4, 4*a* are aligned in parallel to the longitudinal sides of the table top 2 as shown by leaf 4 in FIG. 2. Because the longitudinal sides of each leaf 4, 4*a*, which correspond to the lengths of the broad side of the table top 2, are longer than half the length of the longitudinal side of the table top 2, the two leaves 4, 4*a* fare superimposed (i.e., overlap) in their rest position. The corresponding table leg 3 is used as a bearing point for each leaf 4, 4*a*. Each leaf 4, 4*a* can be swivelled horizontally about a longitudinal center axis of the respective table leg 3.

The supporting arm 5 is rigidly connected with a tube-shaped bearing sleeve 6 which coaxially encloses the table leg 3. The supporting arm 5 projects radially away from the upper end area of the bearing sleeve 6. The supporting arm 5*a* is rigidly connected with a tube-shaped bearing sleeve 6*a* which essentially corresponds to bearing sleeve 6 and which is disposed coaxially on the other cylindrical table leg 3. Both bearing sleeves 6, 6*a* are held on the respective table leg 3 in all axially movable manner and extend in the axial direction along a large portion of the respective table leg 3. A tilting and canting of the leaves 4, 4*a* is avoided by the large axial guiding length of the two bearing sleeves 6, 6*a*. A front edge 7 of the lower end of the bearing sleeve 6 rests against a pin 8 which projects radially away from the table leg 3 and is rigidly connected with the table leg 3. Because of the dead weight of the leaf 4, the supporting arm 5 and the bearing sleeve 6, the surrounding front edge 7 of the bearing sleeve 6 rests on the pin 8 and is supported thereby. The front edge 7 is constructed as a curve which rises in such a manner that the leaf 4, when it is swivelled clockwise (FIG. 2), is vertically displaced from the rest position underneath the table top 2 into the enlarging position at the height of the table top 2.

The swivelling and the vertical displacement of each leaf 4, 4*a* correspond to the known principle described in above-mentioned German Patent No. DE 4,207,743. The curve does not have a linear slope to ensure that, during the swivelling movement, the leaf 4 comes in contact neither with the opposite leaf 4*a* nor with the underside of the table top 2. This is achieved by a slope which at first extends in a flat manner and then more steeply, with the two different slope sections changing or merging into one another without steps in the case of an unillustrated embodiment which nevertheless utilizes the present invention, the leaf 4 is first swivelled along a certain swivel angle out of the rest position at the same level before a curve section which linearly rises relatively steeply, causes the bridging of the height to the table top 2. In either embodiment, however, the guiding devices for the swivelling and vertical displacement of the leaf 4, specifically the guide pins 8 and the curve of the front edge 7, are situated at the lower end of the table leg 3.

The swivelling and vertical displacement of the leaf 4*a* corresponds essentially to that of leaf 4, in which case a guide pin 8*a* and a front edge 7*a* provided with a curve are provided as guiding devices in the area of the lower end of the table leg 3. However, since leaf 4*a* is swivelled out to the same side (in FIG. 2, toward the front in the direction of the arrow 24) from under the table top 2 as is leaf 4, the swivelling of leaf 4*a* takes place counterclockwise. It is advantageous in this embodiment that the table 1 can be positioned with the opposite longitudinal side of the table top 2 directly against a step or a wall of a room and an enlargement of the table 1 is nevertheless possible because both leaves 4, 4*a* are swivelled out at the opposite longitudinal side. Since the two leaves 4, 4*a* are arranged at different parallel planes underneath the table top 2, the curves 7, 7*a* have different slopes in order to vertically displace both leaves 4 and 4*a* in the enlarging position to the same level. The curve 7*a* therefore has a flatter design relative to curve 7. In addition, the leaves 4, 4*a* are much thinner relative to the table top 2 and therefore require only a relatively low height underneath the table top 2 which ensures that sufficient space is available for leg movements also in the rest position of the two leaves 4, 4*a*.

The length of the two radially projecting supporting arms 5, 5*a* relative to the respective opposite leaf 4, 4*a* is dimensioned such that the respective supporting arm 5, 5*a* is not situated in the path of the movement of the opposite leaf 4, 4*a*. In the embodiment of FIGS. 1 and 2, the length of the supporting arm 5, 5*a* is therefore less than the radius of the path of the movement of the opposite leaf 4, 4*a*. As a result, one leaf 4 or 4*a*, when swivelled out of the rest position, is not blocked by the supporting arm 5, 5*a* of the other leaf 4, 4*a* which, because of its arrangement underneath the leaf 4, 4*a*, projects away from the contour of the leaf 4, 4*a*. It is therefore important that the areas of the supporting arm which reach over the leaf contour do not intersect the path of the movement of the other leaf.

In the enlarging or pulled-out position of each leaf 4, 4*a* shown in FIGS. 1 and 2 by a dash-dotted line, each leaf 4, 4*a* is additionally provided with a supporting device 10, 11 which in FIG. 2 is shown only for leaf 4*a*. This supporting device 10, 11 operates at a distance from the bearing of the leaf 4*a* and therefore also at a distance from the longitudinal center axis of the table leg 3. By way of this supporting device 10, 11, a non-positive locking of the leaf 4*a* on the table top 2 in its enlarging or pulled-out position is achieved. Also, the supporting device 10, 11 is used for the vertical support of the leaf 4*a* since, because of the eccentric bearing of the leaf 4*a*, relatively large lever ratios act upon the table leg which, because of the dead weight of the leaf 4*a*, may result in a difference in height between the leaf 4*a* and the table top 2 at the opposite end of the broad side of the table top 2 which is adjoined by the leaf 4*a*. In order to avoid this height difference, the supporting device 10, 11 has a detent pin 10 on the opposite end of the longitudinal edge of-the leaf 4*a* which adjoins the broad-side edge of the table top 2.

The detent pin 10 moves horizontally into a corresponding detent bore 11 during the swivelling into the enlarging or pulled-out position. The detent pin 10 and the detent bore 11 are coordinated with one another such that the detent pin 10 is non-positively held in the detent bore 11 in the lateral edge of the table top 2 so that the leaf 4*a* is locked in the enlarging position. The detent pin 10 and the detent bore 11 are therefore, on one hand, used for the vertical support of the leaf 4, 4*a* and, on the other hand, are used for the horizontal securing on the table top 2. In the case of other embodiments of the present invention, the supporting devices for the respective leaves are constructed as separate supporting and locking elements which., however, in each case, implement the double function of a vertical supporting of the leaves and a horizontal locking of the leaves relative to the table top.

Figure 3:
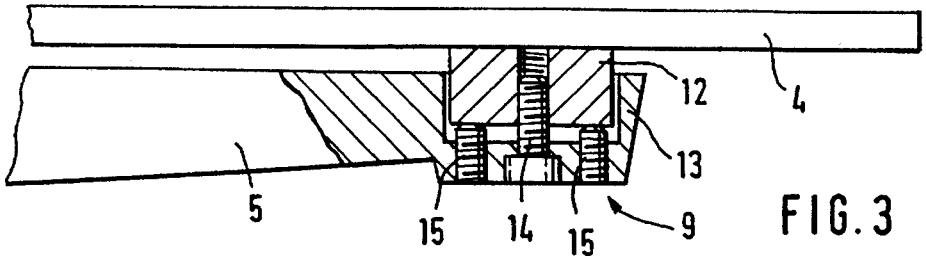
FIG. 3 is an enlarged, partially sectional, isolated view of the vertically adjustable bearing of a leaf on a supporting arm of the type shown in FIG. 2.

According to FIG. 3, each leaf 4, 4*a* is held in the area of its bearing points 9, 9*a* in a vertically adjustable manner on the perspective supporting arm 5, 5*a*. With respect to the leaf 4 shown in FIG. 3, a block-type insertion piece 12 is provided for this vertical adjustability purpose on the underside of the leaf 4 and can be inserted into a corresponding receiving device 13 of the supporting arm 5. Four threaded bolts 15 support the insertion piece 12 and project out of the bottom of the receiving device 13 where they can be screwed in from the underside. By way of a holding screw 14, which is screwed centrically from below into the receiving device 12 and which is held up by the receiving device 13, the insertion piece 12 and therefore the leaf 4 are fixed in the receiving device 13 to permit a sensitive vertical adjustment of the leaf 4 and also thereby a horizontal and parallel alignment of the leaf 4 with respect to the table top 2.

Figure 4:
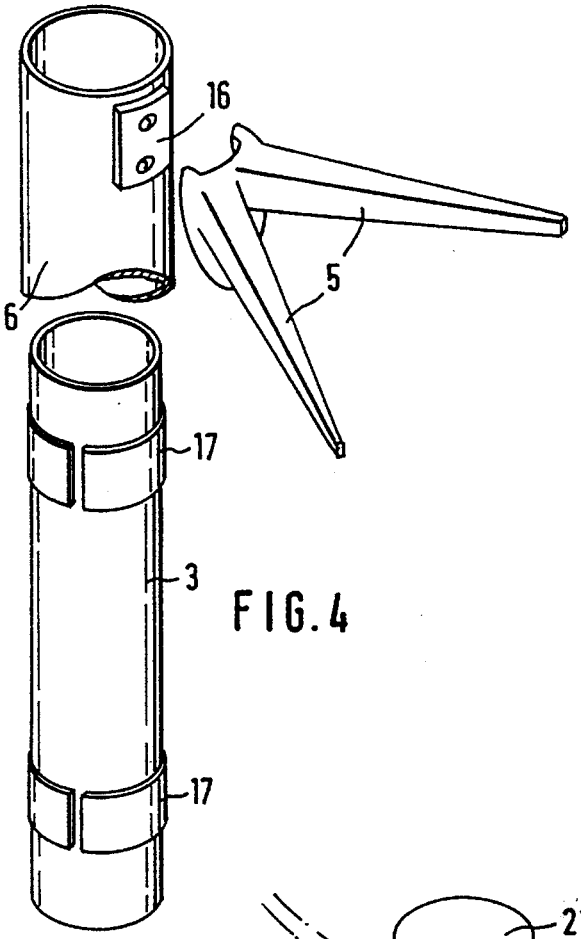
FIG. 4 is an exploded perspective view of the arrangement of a supporting arm for a leaf on a tube-shaped bearing sleeve which can be rotatably disposed on a tube-shaped table leg by way of sheet metal clips.

In the embodiment shown in FIG. 4, each bearing sleeve 6, 6*a* is rotatably and axially displaceably held on the corresponding supporting leg 3 by slide bearings in the form of sheet metal clips 17. The two sheet metal clips 17 are represented by thin plate-type metal sheets which are bent at a distance from one another around the outer circumference of the table leg 3. In another embodiment of the invention, plastic rings are provided as slide bearings. In either case, the two supporting arms 5, 5*a* are detachably fastened to the upper end of the respective bearing sleeve 6, 6*a* by a joining flange 16 which is rigidly mounted by welding or the like on the exterior side of the respective bearing sleeve 6, 6*a* and is provided with two bores. A corresponding projection of the supporting arm 5 can be form-lockingly placed on this bearing sleeve 6 and fastened by two screws which can be screwed into the bores. As a result, it is possible to mount and demount the supporting arm 5 in a simple manner so that the table 1 can be used with or without a leaf 4, 4*a*.

Figure 5:
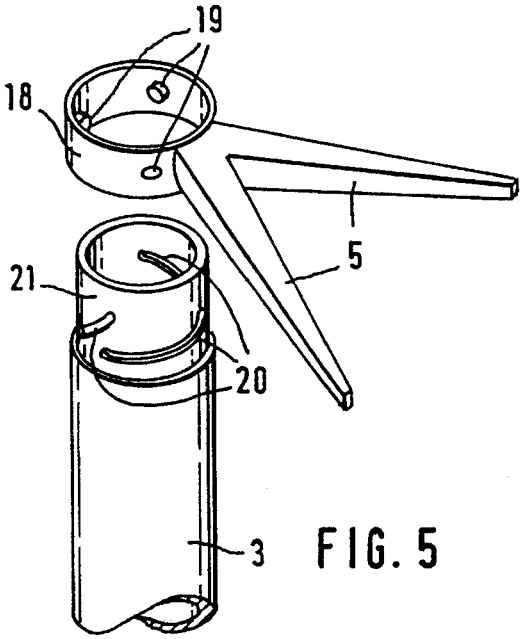
FIG. 5 is an exploded perspective view of another embodiment of the bearing of a supporting arm on a table leg, in which the fork-shaped supporting arm is rigidly connected with a hollow-cylindrical bearing sleeve which is provided with radially inwardly directed cams for the guiding in corresponding connecting link guides of an upper area of a table leg.

In another embodiment of the present invention shown in FIG. 5, which depicts the upper end of the table leg 3, the guiding devices for the swivelling and vertical displacement of the leaves 4, 4*a* are provided in the area of an upper end of the table leg 3. The guiding devices are therefore situated directly on the underside of the table top 2 make it possible to configure the area of the table leg 3 which adjoins this upper end area in the downward direction in any fashion because it is not used for the bearing of the leaf 4, 4*a*. The fork-shaped supporting arm B is joined in a radially projecting manner rigidly to a ring-shaped tube sleeve 18 which constitutes the rotatable bearing part of the bearing and which is provided along its inner circumference in a distributed manner with three cylindrical guide pins 19 which project radially toward the inside. These guide pins 19 engage in three connecting link guides 20 which are constructed in a hollow-cylindrical stepped guide portion 21 of the table leg 3, in which case the guide portion 21 forming the upper end of the table leg 3 is used as a stationary bearing part of the bearing for the leaf 4, 4*a*. The outside diameter of the guide portion 21 and the inside diameter of the tube sleeve 18 are adapted to one another such that, although the tube sleeve 18 is movable according to the restricted guidance by the connecting link guides 20, it can neither cant nor tilt.

The three connecting link guides 20 distributed along the circumference of the guide portion 21 correspond to one another and are used for the support and the secure restricted guidance of the tube sleeve 18. As a result a tilting caused by lever forces, which are generated by the eccentric arrangement of the supporting arm 5 and the leaf 4, is avoided as well as a canting of the tube sleeve 18. The shape and slope of each connecting link guide 20 is curved so that the path of movement of each leaf 4, 4*a* (which was described above in detail) from its rest position into the enlarging position and back is achieved without any contact with the other parts of the table 1. The guide portion 21 is set off from the adjoining area of the table leg 3 by a surrounding step which is, at the same time, used for the support of the tube sleeve 18 in the rest position. In an unillustrated embodiment contemplated by the present invention, the guide portion 21 is not provided with connecting link guides 20 but with a thread having a corresponding pitch, and the tube sleeve 18 has a corresponding internal thread. However, that difference aside, the swivelling and vertical displacement of the supporting arm 5 and the leaf 4, 4*a* correspond to the above-described illustrated embodiments.

In the case of yet another unillustrated embodiment of the present invention, each table leg 3 is provided with a bearing for one leaf respectively so that a total of four leaves are provided for enlarging the table 1. The leaves in their rest position underneath the table are not in different parallel planes but are all situated at one level so that the helical curves in the area of the lower ends of the bearing sleeves also have the same slope. The leaves each extend along half the width of the table top and rest against one another in pairs in a flush manner.

Figure 6:
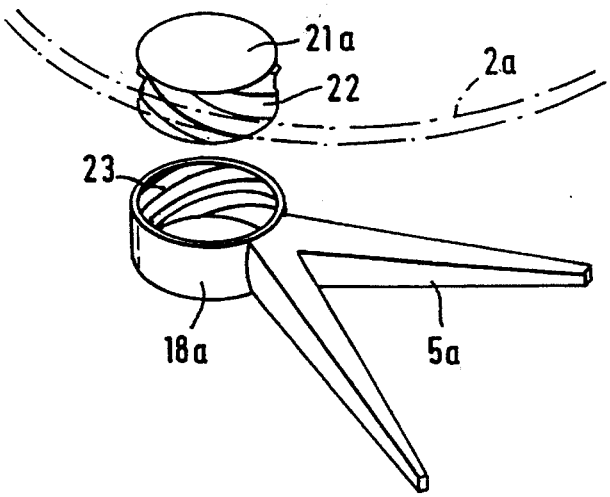
FIG. 6 is an isolated view of another embodiment of the invention in which, for the vertical displacement of the bearing arm, a threaded stopper is arranged on an underside of a table top and on to which a bearing sleeve can be screwed which is provided with an internal thread.

In the embodiment of FIG. 6, the guiding devices for the bearing of the supporting arm 5*a* and therefore of the leaf 4*a* as well as in the case of the embodiment according to FIG. 5, directly adjoin the underside of the table top 2*a*. A cylindrical threaded stump 21*a* is rigidly connected with the underside of the table top 2*a* and is provided with an external thread 22 onto which an internal thread 23 can be screwed of the tube sleeve 18*a* which corresponds essentially to tube sleeve 18. This thread 23 is also constructed such that the maximal swivel angle of the supporting arm 5*a*, and thus of the leaf 4*a* in the form of a three-quarter circle, amounts to 270° and the required vertical displacement is achieved. However, it is advantageous that these guiding devices are not part of a table leg used for supporting the table top 2 but are used only for the bearing of the leaf 4*a*. The bearing stump 21 is-therefore free in the downward direction. As a result, the bearing stump 21*a* and thus also the guiding devices for the leaf 4*a* are arranged independently of any table legs at arbitrary positions in the area of the underside of the table top 2*a* so that there is significant freedom with respect to the configuration. This is particularly advantageous in the case of a round table top 2*a* (shown by a dash-dotted line in FIG. 6) which may be provided with a central adjusting leg. Depending on the configuration of the table top 2*a*, the bearing stump 21*a* may be positioned at a suitable point.

Figure 7:
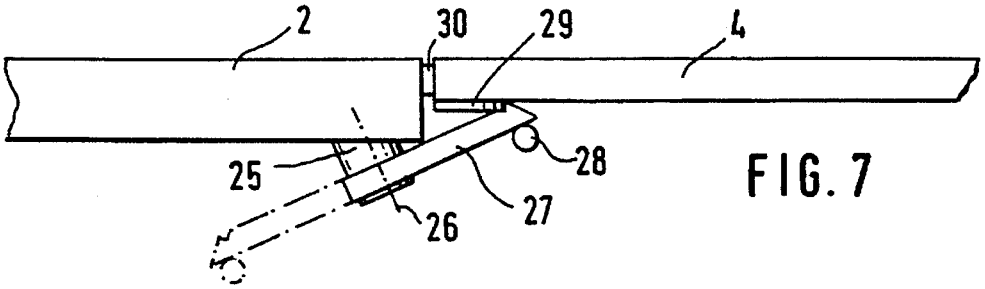
FIGS. 7 and 7*a* are respective partial side and plan views of a further embodiment for the locking and support of the leaf at the table top in which, when the leaf is locked, advantageously a pulling of the leaf against the stationary top and a pressing-up of the leaf to the height is achieved which is aligned with the surface of the stationary top.
Figure 7A:
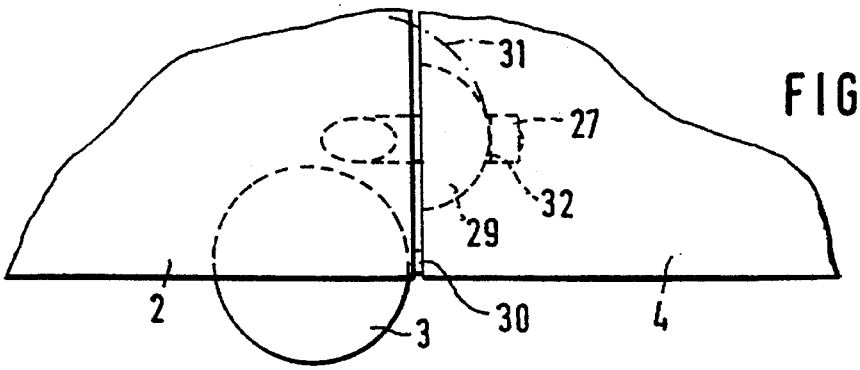

The supporting device according to FIGS. 7 and 7*a* has a locking lever 27 which is arranged on a stationary bearing block 25 so that it can be swivelled about a swivelling axis 26. The bearing block 25 is arranged in the edge area on an underside of the table top 2. The bearing block 25 projects away from the underside of the table top 2 diagonally downward and to the edge of the table top 2 toward the front. The locking lever 27 is swivellably disposed in a radial plane on the bearing block 25, the radial plane, relative to the horizontal surface of the table top 2, constituting an oblique plane. The bearing of the locking lever 27 is so stable that it can absorb vertical loads on the locking lever 27. The locking lever 27 has an upwardly projecting, linear stop edge 32 which, for the locking and support of the leaf 4, is tangentially applied to a circular curve contour of a crescent-shaped locking plate 29. The crescent-shaped locking plate 29 is fastened to an underside of the leaf 4 in the edge area facing the table top 2. The table top 2 as well as the leaf are made of glass so that the bearing block 25 as well as the locking plate 29 are glued to the respective undersides. The radius of the swivel movement of the locking lever 27 is larger than the radius of the curve contour of the crescent-shaped locking plate 29 so that the path of the movement 31 (shown by a dash-dotted line) is obtained for the stop edge 32 of the locking lever 7 (FIG. 7*a*).

For the fastening of the leaf 4 to the table top 2, the leaf 4 is first brought into the proximity of the edge area of the table top 2. Then the locking lever 27 is swivelled from its rest position in the oblique swivel plane (illustrated by a dash-dotted line) by way of a manipulation at the grip button 28, toward the front, in which case the stop edge 32 of the lever 27 comes to rest against the underside of the leaf 4 in the area of the curve contour of the locking plate 29. During the further swivelling of the locking lever 27 toward the center, the leaf 4 is automatically pressed upward and pulled to the edge of the table top 2. In the end position, the leaf 4 is aligned with the surface of the table top 2. Between the mutually facing edges of the leaf 4 and the table top 2, an elastic supporting rubber 30 is situated which is compressed when the leaf 4 is pulled against the table top 2. This generates a counterforce against the form-locking holding force of the locking lever 27, whereby the locking is maintained. The locking lever 27 therefore takes over the vertical support of the edge area of the leaf 4 in the downward direction as well as the securing of the joining position of the leaf 4 against the table top 2. The swivel lever may be released in both directions from the locking position illustrated in FIG. 7*a*.

Figure 8:
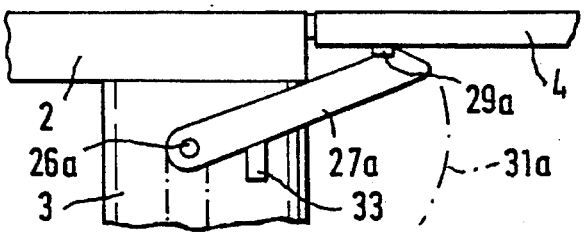
FIGS. 8 and 8*a* are respective side and plan views of another embodiment for the locking and support of the leaf at the table top which has a locking arm which is swivellably disposed on a table leg.
Figure 8A:
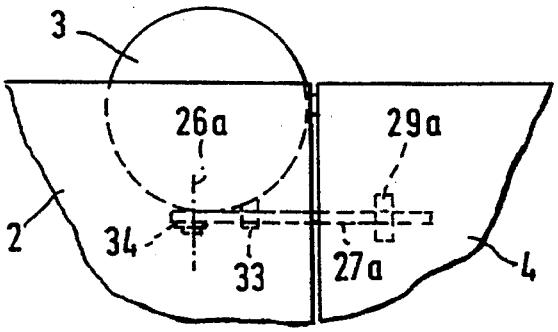

The supporting device according to FIGS. 8 and 8*a* has a locking lever 27*a* which can be swivelled in a vertical swivel plane and which is disposed by a bearing bolt about a horizontal bearing axis 26*a* in the upper area of the table leg 3. In the illustrated locking position, the locking lever 27*a* reaches behind a rectangular locking plate 29*a* arranged on the underside of the leaf 4. The vertical support of the locking lever 27*a* and therefore also the support of the leaf 4 is carried out by a supporting cam 33 which is fastened to the table leg 3 and on which the locking lever 27*a* rests in the locking position. For unlocking, the locking lever 27*a* may be pressed horizontally toward the outside until it can slide laterally downward past the supporting cam 33. In order to permit the horizontal swivelling-away of the locking lever 27*a*, the locking lever 27*a* is disposed on the bearing bolt by a rubber washer 34 so that it can be pressed away laterally. In the vertical direction, the supporting cam 33 has a wedge-shaped configuration so that it has a stopping slope along which the locking lever 27*a* slides when being swivelled up from the rest position indicated by a dash-dotted line, into its locking position and is pressed toward the outside.

Although the invention has been described and illustrated in detail, it is to be clearly understood that the same is by way of illustration and example, and is not to be taken by way of limitation. The spirit and scope of the present invention are to be limited only by the terms of the appended claims.

I claim:

1. A piece of furniture, comprising a stationary top and at least two leaves disposed about a bearing axis of a stationary bearing point situated outside a leaf contour, and guiding devices having slopes configured for swivelling respective ones of the at least two leaves, without interference with each other, parallel to the stationary top and for vertical displaceability thereof about the bearing point between a rest position situated underneath a lower surface of the stationary top and an unfolded position aligned with a height of the stationary top, wherein the at least two leaves are disposed, in the rest position, parallel to and at least partially above one another underneath the lower surface of the stationary top at respectively different levels, and each of the at least two leaves is held by a supporting element having areas situated outside the leaf contour outside a path of movement of the at least one other leaf.

2. The piece of furniture according to claim 1, wherein the leaves are disposed adjacent one edge of the stationary top.

3. The piece of furniture according to claim 1, wherein the leaves are thinner than the stationary top.

4. The piece of furniture according to claim 3, wherein the leaves are disposed adjacent one edge of the stationary top.

5. The piece of furniture according to claim 1, wherein the slopes of each of the guiding devices corresponds at least to the thickness of one of the at least two leaves.

6. The piece of furniture according to claim 1, wherein at least one of the leaves is vertically adjustably held on the supporting arm.

7. The piece of furniture according to claim 6, wherein the leaves are disposed adjacent one edge of the stationary top.

8. The piece of furniture according to claim 7, wherein the leaves are thinner than the stationary top.

* * * * *